United States Patent [19]

Okamoto et al.

[11] Patent Number: 4,906,604

[45] Date of Patent: Mar. 6, 1990

[54] MULTI-COLOR HEAT SENSITIVE RECORDING MATERIAL

[75] Inventors: Tosaku Okamoto, Osaka; Tomoyuki Okimoto, Nishinomiya; Katsuhiko Ishida, Takatsuki, all of Japan

[73] Assignee: Kanzaki Paper Manufacturing Co., Ltd., Tokyo, Japan

[21] Appl. No.: 248,703

[22] Filed: Sep. 23, 1988

[30] Foreign Application Priority Data

Sep. 25, 1987 [JP] Japan ..... 62-241625

[51] Int. Cl.[4] ..... B41M 5/18

[52] U.S. Cl. ..... 503/204; 427/151; 427/152; 428/913; 503/205; 503/226

[58] Field of Search ..... 427/150–152; 428/913, 914; 503/204, 205, 208, 209, 226

[56] References Cited

U.S. PATENT DOCUMENTS

| | | | |
|---|---|---|---|
| 3,916,068 | 10/1975 | Kohmura et al. | 503/205 |
| 4,599,630 | 7/1986 | Ohtaki et al. | 503/204 |
| 4,663,641 | 5/1987 | Iiyama et al. | 503/204 |
| 4,791,095 | 12/1988 | Ikeda et al. | 503/209 |

FOREIGN PATENT DOCUMENTS

| | | | |
|---|---|---|---|
| 3054281 | 3/1988 | Japan | 503/204 |
| 2180274A | 3/1987 | United Kingdom | 503/205 |
| 2184856 | 7/1987 | United Kingdom | 503/209 |

*Primary Examiner*—Bruce H. Hess

*Attorney, Agent, or Firm*—Armstrong, Nikaido Marmelstein Kubovcik & Murray

[57] ABSTRACT

In a multi-color heat sensitive recording material comprising a substrate and two or more heat sensitive color-forming layers thereon capable of forming different colors from each other, at least one of the heat sensitive color-forming layers containing a leuco dye and an acidic substance, the recording material characterized in that at least one piperidine derivative represented by the formula [I]

(I)

wherein $R_1$ is $C_{1\sim30}$ aliphatic group residue which may have $C_{2\sim20}$ alkoxycarbonyl group, or $C_{1\sim30}$ aliphatic group residue which has ether linkage and oxycarbonyl group; $R_2$, $R_3$, $R_4$, $R_5$ and X are each methyl group or hydrogen atom; and l is an integer of 1 to 6, is incorporated at the position where a decolorizing function can be effected against the color-forming system comprising a leuco dye and an acidic substance.

7 Claims, No Drawings

MULTI-COLOR HEAT SENSITIVE RECORDING MATERIAL

The present invention relates to a multi-color heat sensitive recording material containing a plurality of color-forming layers capable of forming different colors from each other.

Hitherto, heat sensitive recording materials which are intended to obtain color images by utilizing color development reaction between a color former and a color acceptor capable of undergoing color development upon contact with the color former and bringing the both color-forming substances into contact with each other upon application of heat have been well known. Since not only such heat sensitive recording materials are relatively inexpensive, but also recording instruments therefor are compact in size and relatively easy in maintenance, the heat sensitive recording materials are being used as recording media not only for facsimile apparatus and calculators but also in other various fields.

However, with an expansion of utility, the required capacity and quality are being diversified to attain, for example, high sensitization, image stabilization, or multi-color recording. Especially, since the multi-color recording includes various applications over a wide range, up to date a number of recording materials have been investigated and proposed.

A conventional two-color heat sensitive recording material is roughly classified into the following two types. In the first type, a low-temperature heat sensitive color-forming layer is colored at the time of low-temperature heating, and both of the low-temperature heat sensitive color-forming layer and a high-temperature heat sensitive color-forming layer are colored at the time of high-temperature heating to obtain a mixed color therebetween. In the second type, a decolorizing agent capable of decolorizing the low-temperature color-forming system at the time of high-temperature heating is used in combination in the aforesaid first type, whereby color formation in only the high-temperature heat sensitive color-forming layer is effected at the time of high-temperature heating.

However, in the first type, the resulting image becomes unclear due to overlap between two colors (hereinafter referred to as "color-overlap"), and causes color stain (phenomenon in which brim of the high-temperature color forming image is thinly surrounded by the low-temperature color forming image). Therefore, the second type is generally suitable as a method for obtaining two-color images. In the second type, various decolorizing agents are used. As a decolorizing agent having a decolorizing effect against the color-forming system comprising a basic leuco dye and an organic acidic substance, for example, there have been proposed the following decolorizing agents: alkylene oxide adducts of bisphenols (JP-A-54-139741); ethylene oxide adducts of terephthalic acid (JP-A-55-25306); long-chain 1,2-glycols (JP-A-55-27217); glycerin fatty acid esters (JP-A-55-113593); urea derivatives (JP-A-55-139290); alkylene oxide adducts of straight-chain glycols (JP-A-55-152094); morpholine derivatives (JP-A-56-40588); solid alcohols (JP-B-50-17865); polyether or polyethylene glycol derivatives (JP-B-50-17867 and JP-B-50-17868); nitrogen-containing crystalline organic compounds (JP-B-51-19991); guanidine derivatives (JP-B-51-29024); and amines or quaternary ammonium salts (JP-A-50-18048).

However, it is the present status that even when these decolorizing agents are used, the color-overlap and color stain cannot be sufficiently prevented so that satisfactory results are not always obtained. Further, some decolorizing agents lower the color-forming ability during preservation with influenced by temperature, humidity, etc.

An object of the present invention is to provide a multi-color heat sensitive recording material capable of forming an image which is high in color density and has a sharp color tone without causing color-overlap and color stain.

An another object of the invention is to provide a multi-color heat sensitive recording material which is not lowered in the color-forming ability with influenced by temperature, humidity, etc., namely which is excellent in preservability.

The above and other objects of the invention will become apparent from the following description.

In a multi-color heat sensitive recording material comprising a substrate and two or more heat sensitive color-forming layers thereon capable of forming different colors from each other, at least one of the heat sensitive color-forming layers containing a leuco dye and an acidic substance, the recording material characterized in that at least one piperidine derivative represented by the formula [I]

(I)

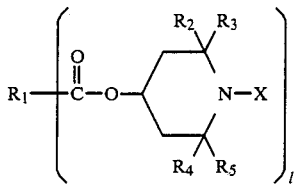

wherein $R_1$ is $C_{1\sim30}$ aliphatic group residue which may have $C_{2\sim20}$ alkoxycarbonyl group, or $C_{1\sim30}$ aliphatic group residue which has ether linkage and oxycarbonyl group; $R_2$, $R_3$, $R_4$, $R_5$ and X are each methyl group or hydrogen atom; and l is an integer of 1 to 6, is incorporated at the position where a decolorizing function can be effected against the color-forming system comprising a leuco dye and an acidic substance.

As described above, an important characteristic of the heat sensitive recording material according to the present invention resides in that at least one piperidine derivative represented by the foregoing formula [I] is incorporated at the position where a decolorizing function can be effected against the color-forming system comprising a leuco dye and an acidic substance.

As preferable examples of the piperidine derivatives represented by the above formula [I] are included the following compounds of the formulae [II] and [III].

[II]

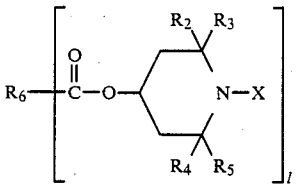

wherein $R_6$ is $C_{1\sim20}$ aliphatic group residue which may have $C_{2\sim20}$ alkoxycarbonyl group, $R_2$, $R_3$, $R_4$, $R_5$, X and l are same as above,

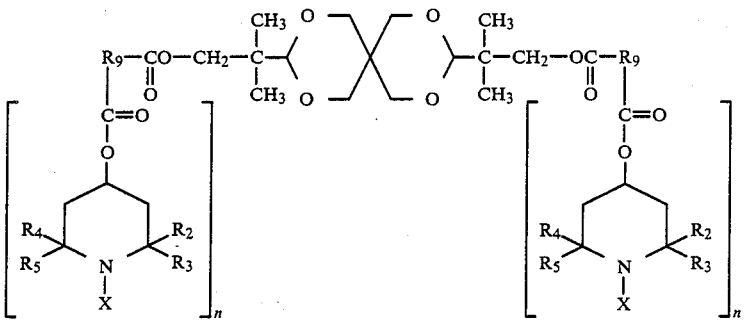

[III]

wherein $R_9$ is $C_{1\sim5}$ aliphatic group residue, n is an integer of 1 to 3, $R_2$, $R_3$, $R_4$, $R_5$ and X are same as above.

Example of the piperidine derivatives represented by the formulae [II] and [III] are shown below but the piperidine derivatives are not limited thereto. (1,2,2,6,6-Pentamethyl-4-piperidyl)-1-heptanecarboxylate, A—O—CO—$C_7H_{15}$

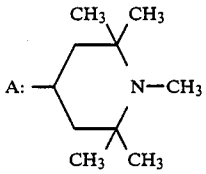

(1,2,2,6,6-Pentamethyl-4-piperidyl)-1-heptadecanecarboxylate, A—O—CO—$C_{17}H_{35}$

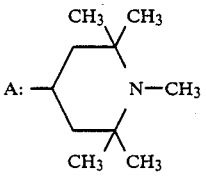

(2,2,6,6-Tetramethyl-4-piperidyl/tridecyl)-1,2-ethanedicarboxylate, B—O—CO—$(CH_2)_2$—CO—O—$C_{13}H_{27}$

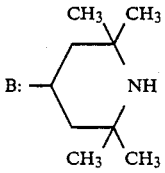

Bis(2,2,6,6-tetramethyl-4-piperidyl)-1,8-octanedicarboxylate, B—O—CO—$(CH_2)_8$—CO—O—B

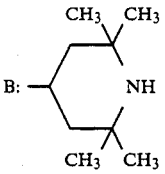

Tris(1,2,2,6,6-pentamethyl-4-piperidyl)-1,1,3-propanetricarboxylate,

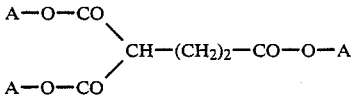

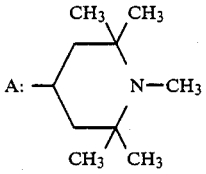

Tetrakis(1,2,2,6,6-pentamethyl-4-piperidyl)-1,2,3,4-butanetetracarboxylate,

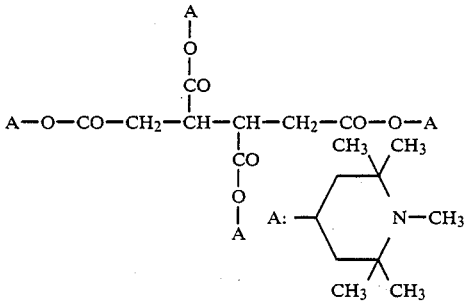

Tetrakis(2,2,6,6-tetramethyl-4-piperidyl)-1,2,3,4-butanetetracarboxylate,

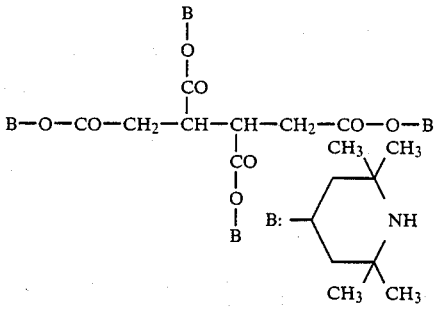

Tetrakis(1,2,2,6,6-pentamethyl-4-piperidyl)-2,2,6,6-heptanetetracarboxylate,

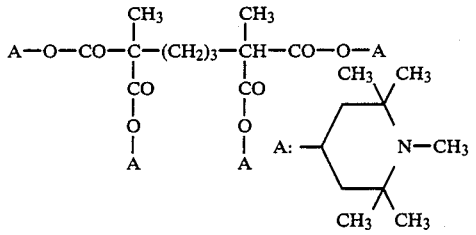

Tetrakis(1-methyl-4-piperidyl)-1,2,3,4-butanetetracarboxylate,

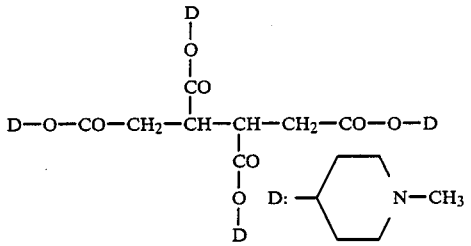

3,9-bis[1,1-dimethyl-2-{tris(2,2,6,6-tetramethyl-4-piperidyloxycarbonyl)butylcarbonyloxy}ethyl]-2,4,8,10-tetraxaspiro[5,5] undecane

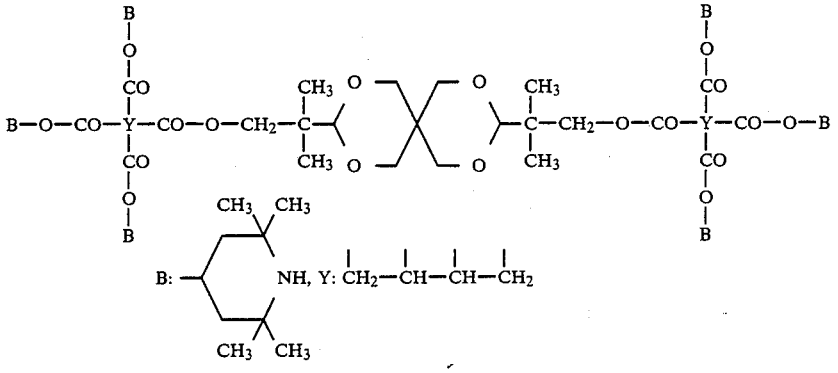

3,9-bis[1,1-dimethyl-2-{tris(1,2,2,6,6, -pentamethyl-4-piperidyloxycarbonyl)butylcarbonyloxy}ethyl]-2,4,8,10-tetraoxaspiro[5,5] undecane

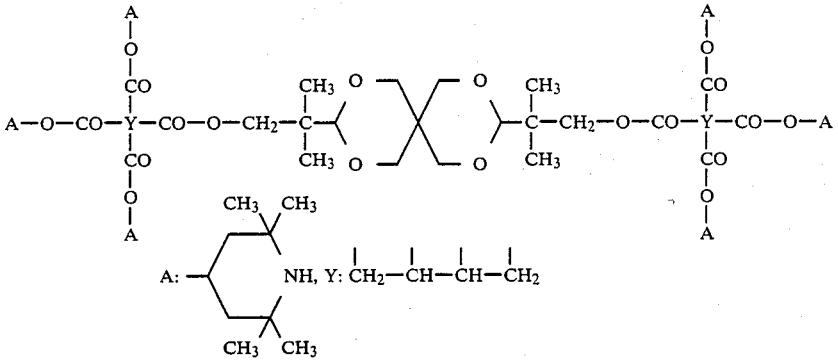

The compound of the formula [I] which is used in the present invention can be used in admixture of two or more thereof. It is preferred that the compound is used in an amount ranging from about 0.1 to 20 times, preferably from 0.5 to 10 times and more preferably from 2 to 10 times the total weight of the leuco dye and the acidic substance in the heat sensitive color-forming system to be decolorized.

Among the piperidine derivatives of the above formulae [II] and [III], preferable are the compounds of the formulae [II'] and [III'] which are capable of producing a multi-color heat sensitive recording material having excellent preservability and color forming ability without causing color-overlap and color stain. Particularly, most preferable is the compound of the formula [II''] below which affords a multi-color heat sensitive recording material having extremely excellent preservability and color forming ability.

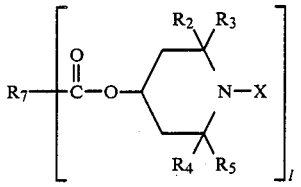

[II']

wherein $R_7$ is $C_{1\sim10}$ aliphatic group residue, $R_2$, $R_3$, $R_4$, $R_5$, X and l are same as above,

[III']

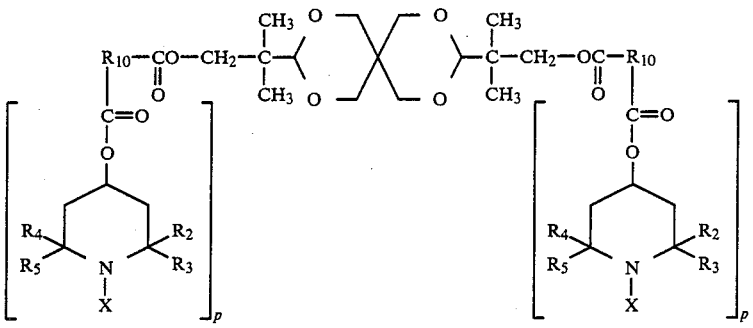

wherein $R_{10}$ is $C_4$ aliphatic group residue, p is 3, $R_2$, $R_3$, $R_4$, $R_5$ and X are same as above,

[II'']

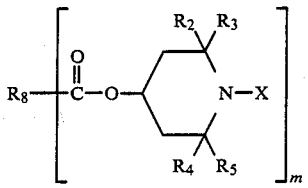

wherein $R_8$ is $C_{2\sim7}$ aliphatic group residue, m is 3 or 4, $R_2$, $R_3$, $R_4$, $R_5$ and X are same as above.

The position which a decolorizing function can be effected, as referred to herein, means a position where the heat sensitive color-forming system to be decolorized and the aforesaid compound can undergo decolorizing reaction and is, for example, corresponding to at least one of a heat sensitive color-forming layer containing the heat sensitive color-forming system, an overcoat layer, an inter-layer, and an undercoat layer. The latter three layers are formed as required. The overcoat layer being formed on the above color-forming layer, the inter-layer being formed between the above color-forming layer and a heat sensitive color-forming layer containing a heat sensitive color-forming system having no decolorizing intention, and the undercoat layer being formed under the above color-forming layer. Among these layers, when the decolorizing agent is contained in at least one of the overcoat layer, inter-layer and undercoat layer, a multi-color heat sensitive recording material is obtained which is excellent in color forming ability without causing decrease in color forming ability. Particularly, it is more preferable to incorporate the decolorizing agent in the inter-layer, because the recording material is prepared which is also excellent in decolorizing effect.

For example, in the case that the color-forming layer containing the color-forming system contains the decolorizing agent, the decolorizing agent can be merely added to a coating composition which forms the color-forming layer. Further, in the case that an overcoat layer, inter-layer or undercoat layer contains the decolorizing agent, the decolorizing agent can be added to a coating composition which constitutes the overcoat layer, inter-layer or undercoat layer. As an inter-layer, it is possible to form a decolorizing layer composed mainly of the decolorizing agent and a resin layer composed mainly of a binder in superposed layers. Needless to say, a number of variations can be employed in the range which falls within the scope of the present invention.

The coating composition for the respective overcoat layer, inter-layer and undercoat layer contains a binder and, as required, a pigment, auxiliary agent or the like.

The above decolorizing agent can be incorporated into a capsule or dispersed in, e.g., water, an organic solvent or an oil. Further, conventionally known decolorizing agents can be used in combination, in an amount which does not cause adverse effect.

The combination of the color former and the color acceptor contained in the color-forming layer, is not particularly restricted, and any combinations by which the both compounds are brought into contact with each other upon application of heat to undergo color development reaction can be employed. For example, there are exemplified a combination of a colorless or pale-colored basic dye (leuco dye) with an inorganic or organic acidic substance and a combination of a higher fatty acid metal salt (e.g., ferric stearate) with a phenol (e.g., gallic acid). Further, the recording material can include as a part of the constitution various heat sensitive color-forming layers in which a color developed (recorded) image is obtainable upon application of heat, such as those comprising a combination of a diazonium compound, a coupler, and a basic substance.

However, since the decolorizing agent as specified in the present invention exhibits a decolorizing function against the color-forming system comprising a basic dye and an acidic substance, at least the color-forming layer to be decolorized must be composed of a color-forming system comprising a basic dye and an acidic substance.

Various colorless or pale-colored basic dyes are known and examples of useful dyes are:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3 -(2-methylindole-3-yl)phthalide, 3,3-bis(1,2-dimethylindole-3-yl)-5-dimethylaminophthalide, 3,3-bis (1,2-dimethylindole-3-yl)-6-dimethylaminophthalide, (9-ethylcarbazole-3-yl)-6-dimethylaminophthalide, 3,3-bis (2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoylleucomethyleneblue, p-nitrobenzoyl-leucomethyleneblue, etc.

Spiro-based dyes, e.g., 3-methyl-spirodinaphthopyran, 3-ethyl-spiro-dinaphthopyran, 3-phenylspiro -dinaphthopyran, 3-benzyl-spiro-dinaphthopyran, 3-methyl-naphtho-(6'-methoxybenzo)spiropyran, 3-propylspirodibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-clorofluoran, 3-diethylamino-6-methyl-7chlorofuoran, 3-diethylamino-7,8-benzofluoran, 3-diethylamino-5-methyl-7-dibenzylaminofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-cyclopentyl-N-ethylamino)-6-methyl-7-anilinofluoran, 3-(N-ethyl-p-toluidino)-6-methyl-7-(p-toluidino)fluoran, 3-diethylamino -6-methyl-7-phenylaminofluoran, 3-dibutylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-tetrahydrofurfurylamino)-6-methyl-7-anilinofluoran, 3-(N-ethyl-N-tetrahydrofurfurylamino)-6-methyl-7-anilinofluoran, etc.

As an acidic substance are used various known inorganic and organic acidic materials which form color in contact with the basic dyes. Examples of useful inorganic acidic materials are activated clay, acid clay, attapulgite, bentonite, colloidal silica and aluminum silicate. Examples of organic acidic materials include 4-tert-butylphenol, 4-hydroxydiphenoxide, $\alpha$-naphthol, $\beta$-naphthol, 4-hydroxyacetophenone, 4-tert-octylcatechol, 2,2'-dihydroxydiphenyl, 2,2'-methylenebis(4-methyl-6-tert-isobutylphenol), 4,4'-isopropylidenebis(2-tert-butylphenol), 4,4'-sec-butylidenediphenol, 4-phenylphenol, 4,4'-isopropylidenediphenol(bisphenol-A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, 4-hydroxyphenyl-4'-isopropoxyphenylsulfone, novolak phenol resin, phenolic polymer and like phenolic compounds; benzoic acid, p-tert -butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-($\alpha$-methylbenzyl)-salicylic acid, 3-chloro-5-($\alpha$-methylbenzyl)-salicylic acid, 3,5-di-tert-butylsalicylic acid, 3-phenyl-5-($\alpha$, $\alpha$-dimethylbenzyl)salicylic acid, 3,5-di-$\alpha$-methylbenzylsalicylic acid and like aromatic carboxylic acids; also, salts of such phenolic compounds or aromatic carboxylic acids with zinc, magnesium, aluminum, calcium, titanium, manganese, tin, nickel and like polyvalent metals, etc.

With the heat-sensitive recording materials of the invention, the proportions of color former and color acceptor to be used for the color-forming layer (recording layer) are not particularly limited but can be determined suitably according to the kinds of color former and color acceptor. For example when a basic dye and an acidic substance are used, usually 1 to 50 parts by weight, preferably 1 to 10 parts by weight, of the acidic substance is used per part by weight of the basic dye.

For preparing a coating composition comprising the foregoing components, the color former and the color acceptor are dispersed, together or individually, into water serving as a dispersion medium, using stirring and pulverizing means such as a ball mill, attrition mill or sand mill. Usually the coating composition has incorporated therein a binder in an amount of 10 to 70% by weight, preferably 15 to 50% by weight, based on the total solids content of the composition. Examples of useful binders are starches, hydroxyethyl cellulose, methyl cellulose, carboxymethyl cellulose, gelatin, casein, gum arabic, polyvinyl alcohol, diisobutylene-maleic anhydride copolymer salt, styrene-maleic anhydride copolymer salt, ethylene-acrylic acid copolymer salt, styrene-acrylic acid copolymer salt, emulsion containing natural rubber, styrene-butadiene copolymer emulsion, acrylonitrile-butadiene copolymer emulsion, methyl methacrylate-butadiene copolymer emulsion, polychloroprene emulsion, vinyl acetate emulsion, ethylene-vinyl acetate emulsion, etc. Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, alginates, fatty acid metal salts, etc., ultraviolet absorbers such as benzophenone and triazole compounds, defoaming agents, fluorescent dyes, coloring dyes, etc.

Further, to the composition may be added zinc stearate, calcium stearate, polyethylene wax, carnauba wax, paraffin wax, ester wax or like waxes; calcium carbonate, zinc oxide, aluminum oxide, titanium dioxide, silicon dioxide, aluminum hydroxide, barium sulfate, zinc sulfate, talc, kaolin, clay, calcined clay, colloidal silica or like inorganic pigment; styrene microball, nylon powder, polyethylene powder, urea-formalin resin filler, raw starch particle or like organic pigment; and stearic acid amide, stearic acid methylenebisamide, oleic acid amide, palmitic acid amide, coconut fatty acid amide or like fatty acid amides, 2,2'-methylenebis(4-methyl-6-tert-butylphenol), 4,4'-butylidenebis(6-tert-butyl-3-methylphenol), 1,1,3-tris(2-methyl-4-hydroxy-5-tert-butylphenyl)butane or like hindered phenols, dibenzyl terephthalate, 1,2-di(3-methyl-phenoxy)ethane, 1,2-diphenoxyethane, p-benzylbiphenyl, phenyl 1-hydroxy-2-naphthoate, 4,4'-ethylenedioxy-bis-benzoic acid diphenylmethyl ester, and various known heat-fusible materials.

In the case that the color-forming layer contains an inorganic or organic pigment, it is preferred to use a pigment having a particle size as small as possible, especially one having an average particle size of not more than 2 $\mu$m.

In the present recording material, the method of forming the recording layer, overcoat layer, inter-layer or undercoat layer is not particularly limited, but conventional techniques are usable. For example, the respective coating composition is applied to a substrate by an air knife coater, blade coater or like suitable means and dried. The amount of coating composition for the recording layer to be applied, which is not limited particularly, is usually 1 to 12 g/m$^2$, preferably 1.5 to 10 g/m$^2$, more preferably 3 to 10 g/m$^2$, based on dry weight. The coating composition for the respective overcoat layer, inter-layer and undercoat layer is applied preferably in an amount of 1 to 10 g/m$^2$ based on dry weight.

The substrate is not particularly limited, and papers (e.g., wood-free paper, paper manufactured by a Yankee machine, machine glazed paper, cast-coated paper, art paper, coated paper, and ground wood pulp containing coated paper), synthetic fiber papers, and synthetic resin films can be used.

The color-forming layer after application with the coating composition and drying can be subjected to smoothing processing such as supercalendering, if desired. Further, a protective layer can be provided on the color-forming layer for the purpose of protecting the color-forming layer. Moreover, various known techniques in the field of heat sensitive recording material, such as provision of an undercoat layer or a backcoat layer to the substrate, can be employed. A pressure sensitive adhesive layer can be provided on the rear surface of the substrate.

Further, with respect to the materials and color tones of the color-forming systems constituting the various color-forming layers of the multi-color heat sensitive recording material, a number of variations can be employed and appropriately chosen depending on the contemplated multi-color heat sensitive recording material.

The thus obtained heat sensitive recording material of the present invention is an extremely excellent multicolor heat sensitive recording material by which a recorded image having a high color density and sharp color tone without causing color-overlap and color stain can be obtained.

The invention will be described below in more detail with reference to Examples and Comparison Examples by no means limited to, in which parts and percentages are all by weight, unless otherwise specified.

EXAMPLE 1

Composition (A)

| | |
|---|---|
| 3-Diethylamino-7,8-benzofluoran | 10 parts |
| 5% Aqueous solution of methyl cellulose | 5 parts |
| Water | 25 parts |

These components were pulverized by a sand mill to prepare Composition (A) having an average particle size of 3 μm.

Composition (B)

| | |
|---|---|
| 3-(N—Cyclohexyl-N—methylamino)-6-methyl-7-phenylaminofluoran | 10 parts |
| Dibenzyl terephthalate | 20 parts |
| 5% Aqueous solution of methyl cellulose | 15 parts |
| Water | 80 parts |

These components were pulverized by a sand mill to prepare Composition (B) having an average particle size of 3 μm.

Composition (C)

| | |
|---|---|
| 4,4'-Isopropylidenediphenol | 30 parts |
| 5% Aqueous solution of methyl cellulose | 30 parts |

-continued

| | |
|---|---|
| Water | 70 parts |

These components were pulverized by a sand mill to prepare Composition (C) having an average particle size of 3 μm.

Composition (D)

| | |
|---|---|
| Tetrakis (2,2,6,6-tetramethyl-4-piperidyl)-1,2,3,4-butanetetracarboxylate | 50 parts |
| 5% Aqueous solution of methyl cellulose | 25 parts |
| Water | 110 parts |

These components were pulverized by a sand mill to prepare Composition (D) having an average particle size of 3 μm.

[Preparation of a coating composition for high-temperature heat sensitive recording layer]

A 40-part quantity of Composition (A), 130 parts of Composition (C), 30 parts of silicon oxide pigment (Mizukasil P-527, Mizusawa Chemical Co., Ltd.), 75 parts of 20% aqueous solution of oxidized starch and 70 parts of water were mixed with stirring to prepare a coating composition.

[Preparation of a coating composition for low-temperature heat sensitive recording layer]

A 125-part quantity of Composition (B), 130 parts of Composition (C), 30 parts of silicon oxide pigment (Mizukasil P-527, Mizusawa Chemical Co., Ltd.), 150 parts of 20% aqueous solution of oxidized starch and 55 parts of water were mixed with stirring to prepare a coating composition.

[Preparation of a coating composition for decolorizing layer]

A 185-part quantity of Composition (D) and 50 parts of 20% aqueous solution of oxidized starch were mixed with stirring to prepare a coating composition.

[Preparation of a recording layer]

To a paper substrate weighing 50 g/m$^2$ were applied the above coating composition for high-temperature heat sensitive recording layer, coating composition for decolorizing layer and coating composition for low-temperature heat sensitive recording layer in this order in amounts of 6 g/m$^2$, 4 g/m$^2$ and 3 g/m$^2$ by dry weight respectively. The coated substrate was dried and subjected to supercalendering to obtain a two-color heat sensitive recording paper.

EXAMPLE 2

A two-color heat sensitive recording paper was prepared in the same manner as in Example 1 except that, in the preparation of Composition (D), tris(1,2,2,6,6-pentamethyl-4-piperidyl)-1,1,3-propanetricarboxylate was used in place of tetrakis(2,2,6,6-tetramethyl-4-piperidyl)-1,2,3,4-butanetetracarboxylate.

EXAMPLE 3

A two-color heat sensitive recording paper was prepared in the same manner as in Example 1 except that, in the preparation of Composition (D), tetrakis(1,2,2,6,6-pentamethyl-4-piperidyl)-1,2,3,4-butanetetracarboxylate was used in place of tetrakis(2,2,6,6-tetramethyl-4-piperidyl)-1,2,3,4-butanetetracarboxylate.

EXAMPLE 4

A two-color heat sensitive recording paper was prepared in the same manner as in Example 1 except that, in the preparation of Composition (D), bis(2,2,6,6-tetramethyl-4-piperidyl)-1,8-octanedicarboxylate was used in place of tetrakis(2,2,6,6-tetramethyl-4-piperidyl)-1,2,3,4-butanetetracarboxylate.

EXAMPLE 5

A two-color heat sensitive recording paper was prepared in the same manner as in Example 1 except that, in the preparation of Composition (D), 3,9-bis[1,1-dimethyl-2-{tris(1,2,2,6,6-pentamethyl-4-piperidyloxycarbonyl)butylcarbonyloxy}ethyl]-2,4,8,10-tetraoxaspiro[5,5]undecane was used in place of tetrakis-(2,2,6,6-tetramethyl-4-piperidyl)-1,2,3,4-butanetetracarboxylate.

EXAMPLE 6

Composition (E)

| | |
|---|---|
| Tetrakis (1,2,2,6,6-pentamethyl-4-piperidyl)-1,2,3,4-butanetetracarboxylate | 50 parts |
| 5% Aqueous solution of methyl cellulose | 25 parts |
| Water | 110 parts |

These components were pulverized by a sand mill to prepare Composition (E) having an average particle size of 3 μm.

[Preparation of a coating composition for high-temperature heat sensitive recording layer]

A coating composition was prepared in the same manner as in Example 1.

[Preparation of a coating composition for low-temperature heat sensitive recording layer]

A coating composition was prepared in the same manner as in Example 1.

[Preparation of a coating composition for decolorizing layer]

A 185-part quantity of Composition (E) and 50 parts of 20% aqueous solution of oxidized starch were mixed with stirring to prepare a coating composition.

[Preparation of a coating composition for an intermediate resin layer]

A 100-part quantity of 10% aqueous solution of polyvinyl alcohol, 20 parts of kaolin and 50 parts of water were mixed with stirring to prepare a coating composition.

[Preparation of a recording layer]

To a paper substrate weighing 50 g/m$^2$ were applied the above coating composition for high-temperature heat sensitive recording layer, coating composition for an intermediate resin layer, coating composition for decolorizing layer and coating composition for low-temperature heat sensitive recording layer in this order in amounts of 6 g/m$^2$, 3 g/m$^2$, 4 g/m$^2$ and 3 g/m$^2$ by dry weight respectively. The coated substrate was dried and subjected to supercalendering to obtain a two-color heat sensitive recording paper.

EXAMPLE 7

A two-color heat sensitive recording paper was prepared in the same manner as in Example 6 except that, in the preparation of Composition (E), 3,9-bis[1,1-dimethyl-2-{tris(1,2,2,6,6-pentamethyl-4-piperidyloxycarbonyl)butylcarbonyloxy}ethyl]-2,4,8,10-tetraoxaspiro[5,5]undecane was used in place of tetrakis-(1,2,2,6,6-pentamethyl-4-piperidyl)-1,2,3,4-butanetetracarboxylate.

COMPARISON EXAMPLE 1

A two-color heat sensitive recording paper was prepared in the same manner as in Example 1 except that, in the preparation of Composition (D), 2-(4'-morpholinodithio)benzothiazole was used in place of tetrakis(2,2,6,6-tetramethyl-4-piperidyl)-1,2,3,4-butanetetracarboxylate.

COMPARISON EXAMPLE 2

A two-color heat sensitive recording paper was prepared in the same manner as in Example 1 except that, in the preparation of Composition (D), N,N'-bis(benzoyl)piperazine was used in place of tetrakis(2,2,6,6-tetramethyl-4-piperidyl)-1,2,3,4-butanetetracarboxylate.

COMPARISON EXAMPLE 3

A two-color heat sensitive recording paper was prepared in the same manner as in Example 1 except that, in the preparation of Composition (D), triphenylguanidine was used in place of tetrakis(2,2,6,6-tetramethyl-4-piperidyl)-1,2,3,4-butanetetracarboxylate.

Ten kinds of two-color heat sensitive recording papers thus prepared were checked for dynamic color forming property and preservability of the recording paper by the following methods.

DYNAMIC COLOR FORMING PROPERTY

[Recording condition]

Thermal printer: PS-8600, Rhom Co., Ltd.

Thermal head: 8 dots/mm; about 1300Ω/dot in resistance

Main scanning recording speed: 20 m sec/line

Subscanning: 32 line/mm

Input: 0.44 W/dot

Low temperature color forming energy: 0.26 mJ

High temperature color forming energy: 1.06 mJ

Color density of the recorded image was measured by use of Macbeth densitometer (Model RD-914, Macbeth Corp.), with use of a visual filter for black color image by low temperature and with use of a green filter for red color image by high temperature. The results were given in Table 1.

Further, in order to check the color-overlap of the color image by high temperature, color density of blue component was measured with use of a red filter. The results were also shown in Table 1. The smaller the value, the less is color-overlap, which indicates the image is sharp in red color formation.

The color image was checked for color stain with the unaided eye. The results were given in Table 1, in which ○ indicates no color stain, X color stain.

Preservability

After allowed to stand at 40° C. and 90% RH for 24 hours, the heat sensitive recording paper was recorded at the above conditions. Color density and degree of color-overlap of the color images by low and high temperatures were evaluated. The results were shown in Table 1.

TABLE 1

| | Just after preparation | | | After preservation | | | Color stain |
|---|---|---|---|---|---|---|---|
| | A | B | C | A | B | C | |
| Ex. 1 | 1.06 | 1.14 | 0.08 | 1.03 | 1.18 | 0.08 | O |
| 2 | 1.05 | 1.16 | 0.07 | 1.01 | 1.18 | 0.07 | O |
| 3 | 1.07 | 1.15 | 0.07 | 1.03 | 1.19 | 0.07 | O |
| 4 | 0.96 | 1.03 | 0.09 | 0.90 | 1.12 | 0.06 | O |
| 5 | 1.05 | 1.15 | 0.09 | 0.96 | 1.13 | 0.09 | O |
| 6 | 1.17 | 1.15 | 0.11 | 1.13 | 1.18 | 0.12 | O |
| 7 | 1.14 | 1.15 | 0.14 | 1.05 | 1.12 | 0.14 | O |
| Com. Ex. 1 | 1.13 | 1.12 | 0.65 | 1.10 | 1.12 | 0.67 | X |
| 2 | 0.98 | 1.03 | 0.07 | 0.73 | 0.92 | 0.06 | O |
| 3 | 1.16 | 1.13 | 0.65 | 1.12 | 1.13 | 0.63 | X |

[Note]
A: Color density of the image by low temperature
B: Color density of the image by high temperature
C: Degree of color-overlap Table 1 shows the present multi-color heat sensitive recording material is excellent both in the preservability and color forming ability without causing color-overlap and color stain.

We claim:

1. In a multi-color heat sensitive recording material comprising a substrate and two or more heat sensitive color-forming layers thereon capable of forming different colors from each other, at least one of the heat sensitive color-forming layers containing a leuco dye and an acidic substance, the recording material characterized in that at least one piperidine derivative represented by the formula [I]

(I)

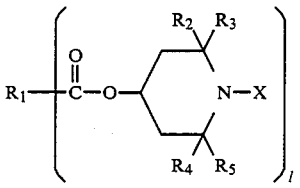

wherein $R_1$ is $C_{1\sim30}$ aliphatic group residue which may have $C_{2\sim20}$ alkoxycarbonyl group, or $C_{1\sim30}$ aliphatic group residue which has ether linkage and oxycarbonyl group; $R_2$, $R_3$, $R_4$, $R_5$ and X are each methyl group or hydrogen atom; and l is an integer of 1 to 6, is incorporated at the position sufficient to decolorized color-forming system comprising a leuco dye and an acidic substance.

2. A multi-color heat sensitive recording material as defined in claim 1 wherein the piperidine derivative is a compound of the formula

[II]

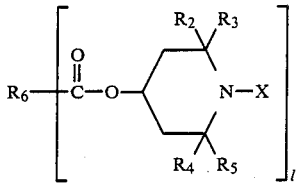

wherein $R_6$ is $C_{1\sim20}$ aliphatic group residue which may have $C_{2\sim20}$ alkoxycarbonyl group, $R_2$, $R_3$, $R_4$, $R_5$, X and l are same as above.

3. A multi-color heat sensitive recording material as defined in claim 2 wherein the piperidine derivative is a compound of the formula

[II']

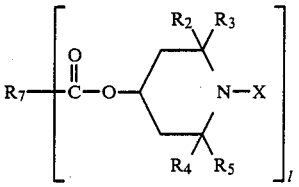

wherein $R_7$ is $C_{1\sim10}$ aliphatic group residue, $R_2$, $R_3$, $R_4$, $R_5$, X and l are same as above.

4. A multi-color heat sensitive recording material as defined in claim 3 wherein the piperidine derivative is a compound of the formula

[II'']

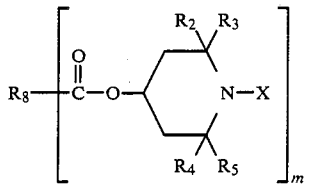

wherein $R_8$ is $C_{2\sim7}$ aliphatic group residue, m is 3 or 4, $R_2$,$R_3$, $R_4$, $R_5$ and X are same as above.

5. A multi-color heat sensitive recording material as defined in claim 1 wherein the piperidine derivative is a compound of the formula

[III]

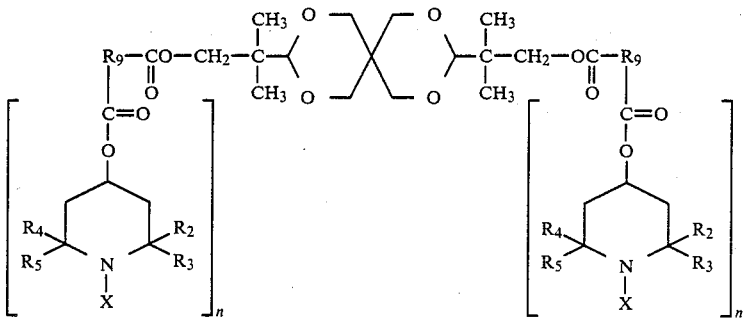

wherein $R_9$ is $C_{1\sim5}$ aliphatic group residue, n is an integer of 1 to 3, $R_2$, $R_3$, $R_4$, $R_5$ and X are same as above.

6. A multi-color heat sensitive recording material as defined in claim 5 wherein the piperidine derivative is a compound of the formula

[III']
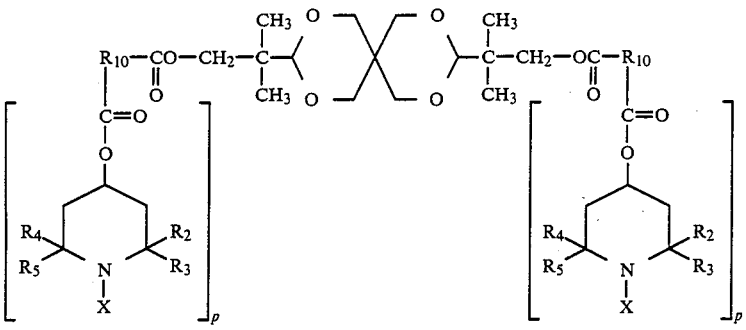
wherein $R_{10}$ is $C_4$ aliphatic group residue, p is 3, $R_2$, $R_3$, $R_4$, $R_5$ and X are same as above.
7. A multi-color heat sensitive recording material as defined in claim 1 wherein the piperidine derivative is used in an amount of 0.1 to 20 times the total weight of the leuco dye and acidic substance.
* * * * *